United States Patent [19]

Eickmann

[11] Patent Number: 4,480,532

[45] Date of Patent: Nov. 6, 1984

[54] FOSSIL FUEL COMBUSTION-STEAM ENGINES AND ELEMENTS FOR FLUID HANDLING DEVICES

[76] Inventor: Karl Eickmann, 2420, Hayama-machi, Kanagawa-ken, Isshiki, Japan

[21] Appl. No.: 338,741

[22] Filed: Jan. 11, 1982

[51] Int. Cl.[3] ..... F01B 31/08

[52] U.S. Cl. ..... 92/144; 123/193 C

[58] Field of Search ..... 92/144; 123/41.72, 193 C

[56] References Cited

U.S. PATENT DOCUMENTS 1,581,280 4/1926 Mauss ..... 123/41.72

2,678,247 5/1954 Geyer et al. ..... 92/114 X

*Primary Examiner*—Stephen F. Husar

[57] ABSTRACT

External chambers are applied around the working cylinder of an engine to permit high temperature for mechanically weak materials for the very hot parts of the engine, when the external chambers are filled with plural different pressures substantially equal to that in plural different pressure areas in the working cylinder.

1 Claim, 11 Drawing Figures

Fig. 4
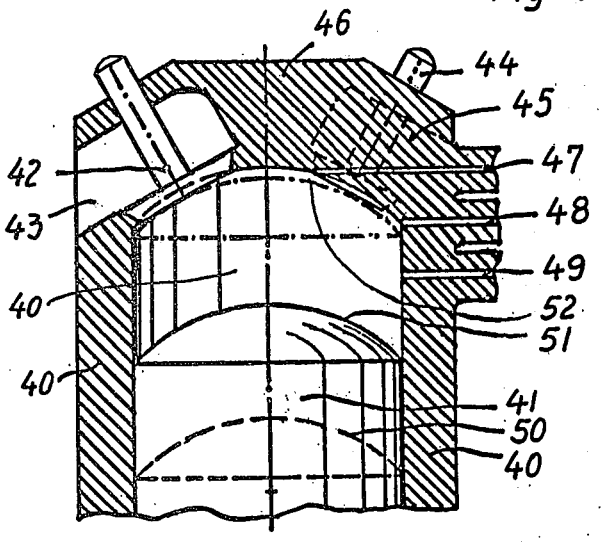
Fig. 8
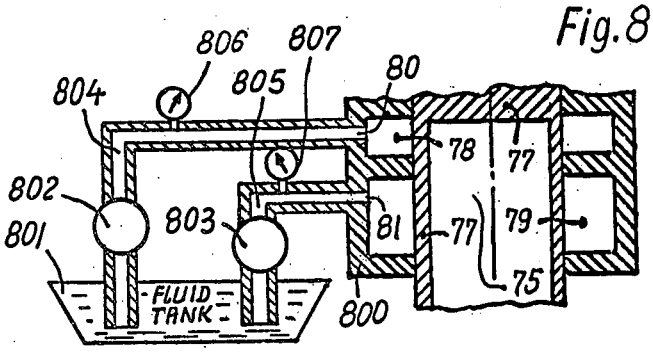
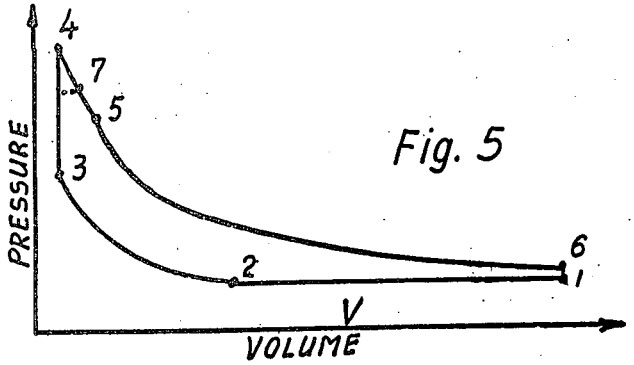
Fig. 5

Fig. 6
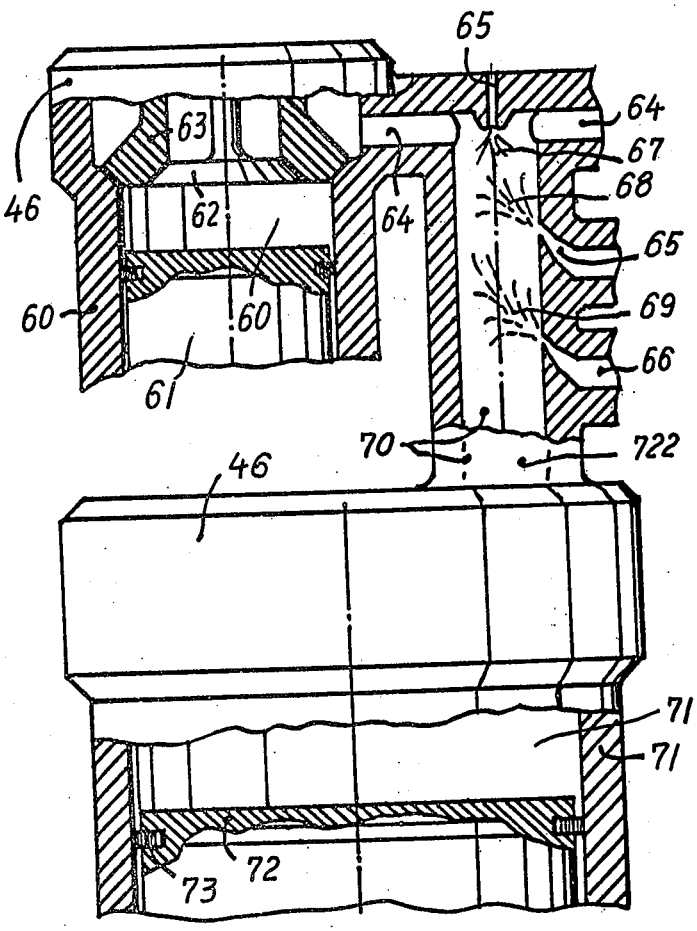
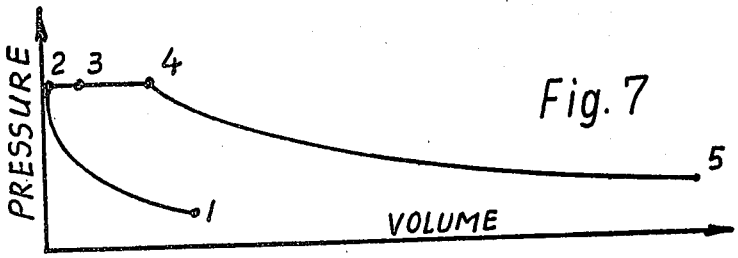
Fig. 7

Fig. 11

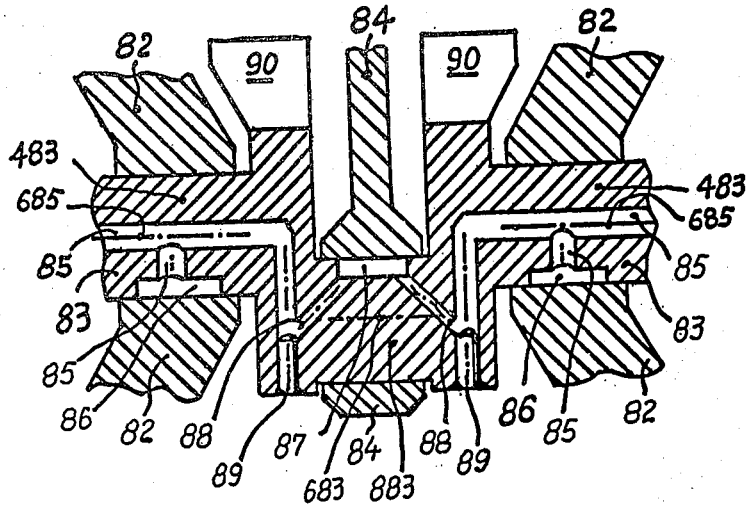

$tg.\varkappa = \Delta Y / \Delta R$ $\Delta Y = \Delta R \; tg.\varkappa$ $dY = tg\varkappa \; dR$ $f = tg.\varkappa_f (R_o - r_i)$ $dA = (1/2) dR \, dY$ $= 0.5 dR \times tg\varkappa dR$ $= 0.5 tg\varkappa \, dR dR$ $dV = dA \Phi \pi = dA \, 2R\pi$ $= 2R\pi dA$ $= 2R\pi \, 0.5 \, tg\varkappa \, dR dR$

Fig. 10

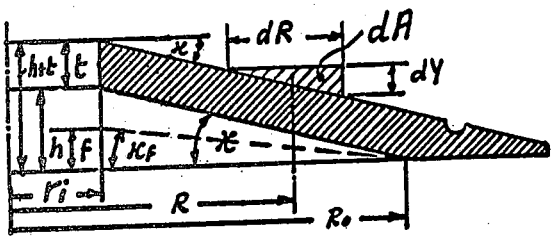

$V = \int \pi tg.\varkappa R dR dR = \pi tg\varkappa \int R dR dR = \pi tg\varkappa \int (1/2) R^2 dR = \pi tg\varkappa (1/2)(1/3) R^3$ $= \pi tg\varkappa (1/6) R^3$ in bondaries $|_{r_i}^{R_o}$ $= V = (\pi/6)$ tangent $\varkappa \, [R_o^3 - r_i^3]$ $V_{ELEMENT} = (\pi/6) \, tang \, \varkappa \, (R_o^3 - r_i^3)$ $V_{TOTAL} = (\pi/6) \, tang \, \varkappa \, (R_o^3 - r_i^3) + r_i^2 \pi h$ $V_f = (\pi/6) \, tang \, \varkappa_f \, (R_o^3 - r_i^3) + r_i^2 \pi \, tang \, \varkappa_f (R_o - r_i)$ WITH V = DELIVERY VOLUME; tan = tangent

FOSSIL FUEL COMBUSTION-STEAM ENGINES AND ELEMENTS FOR FLUID HANDLING DEVICES

REFERENCE TO RELATED APPLICATIONS

The major portion of this application is a new invention. Other portions of the application are, however, closely related to my U.S. patent applications, Ser. Nos. 224,769, now abandoned, and 282,990 which where filed on Jan. 13, 1981 and on July 14, 1981 respectively, as well as to my application Ser. No. 468,106 which was filed on Feb. 22, 1983 and is now still co-pending. As far as the mentioned relationships exist, the priorities of the mentioned applications are claimed herewith for the respective portions of the present application.

BACKGROUND OF THE INVENTION

1. Description of the Prior Art

Closely related former art is not yet known to me. I therefore consider the former art to be the generally known disc springs and the generally known four stroke and two stroke gasoline and diesel engines. A further former art may consist partially in my own patents, which are summarized by numbers of U.S. and Japanese patents in my co-pending Japanese patent application Ser. No. 54-164,869 of Dec. 20, 1979, published under number 56-92376 on July 27, 1981.

I assume, that the former art has drawbacks, which shall at least partially be overcome by the present invention.

2. Field of the Invention

This invention is related to improvements of combustion engines, crankshafts of combustion engines, improvements of fossil fuel combustion engines to a combination of fossil fuel and water steaming steam engine, as well as to elements to be used in pumps, compressors, motors or engines, whereby the elements may include tapered or coned portions with spring-actions and strengtheners thereon.

SUMMARY OF THE INVENTION

One object of the invention is, to provide strengthening portions on a tapered disc with spring-action capabilities in order to increase the critical pressure point of elements with such tapered discs at use in pumps or motors to a higher pressure of the critical pressure point.

Another object of the invention is, to provide additional plates and seal seats to an assembly of at least two tapered discs for the provision of a pumping element assembly for high pressure pumping, which may include the pumping of water.

A still further object of the invention is, to provide an improved crankshaft to reciprocating compressors, motors and combustion engines, wherein fluid pressure pockets are provided and filled with lubrication fluid under pressure in order to carry the load of centrifugal forces which act on the crankshaft at least partially by the pressure in the pockets and the surrounding sealing lands in order to increase the rpm of the engines. Thereby the output power of a given engine will be increased, while at the same time the weight of the engine might become decreased by eliminating the counter weight portions of presently used common crankshafts.

And, a final object of the invention is, to provide a fossil fuel combustion and steam engine, wherein fossil fuel, like gasoline, coal, petrol, oil or the like is burned in compressed hot air and water or steam is injected under high pressure to form small droplets which in the hot burned gases vaporize very fast to steam, whereby the water steaming takes the heat for steaming the water out of the heat of the hot combustion gas and thereafter participates in the expansion of the gas-steam mixture during the expansion or power stroke of the piston or expander of the engine. This final object of the invention provides such engine for constant volume or mixed constant volume and pressure-combustion in a cylinder as an internal combustion engine as well as for external combustion and steaming in an external combustion- and steaming-chamber between at least one compressor and at least one expander of such external fuel combustion and steam engine.

BRIEF DESCRIPTION OF THE DRAWING

FIG. 4 is a longitudinal sectional view through an engine of the invention.

FIG. 5 is a diagram of the engine of FIG. 4.

FIG. 6 is a longitudinal sectional view through an engine of the invention.

FIG. 7 is a diagram of the engine of FIG. 6.

FIG. 8 is a longitudinal sectional view through an arrangement of the invention.

FIG. 10 is is a mathematical explanation of an element of the invention. And, FIG. 11 is a longitudinal sectional view through a crankshaft of the invention.

DESCRIPTION OF THE PREFERRED EMBODIMENTS

Figure 1:
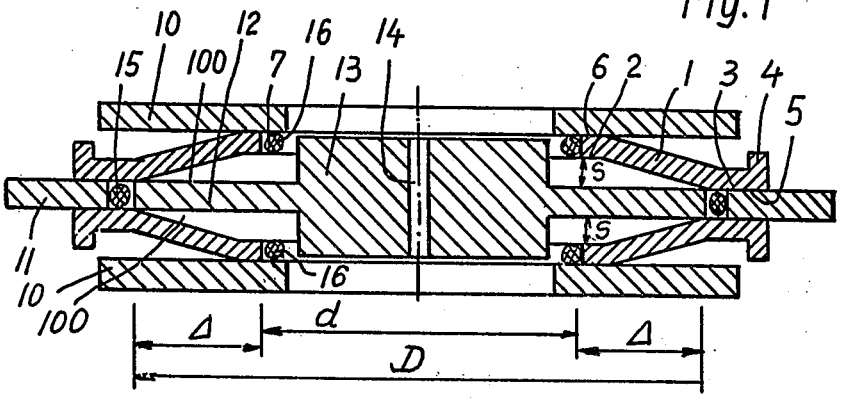
FIG. 1 is a longitudinal sectional view through an assembly of the invention.

Referring firstly to FIG. 1, the tapered element 1 has a tapered portion 1 like a disc spring. It is flexible and has a spring action capability in axial direction parallel to the axis of bore 14. The disclike element is hollow with a radial inner end 7. In FIG. 1 a plurality of such elements 1 are laid together in at least one pair of elements or disc. Each element of a pair is turned 180 degrees whereby the elements 1 are facing each other symmetrically relatively to a medial radial imaginary plane perpendicular to axis or bore 14.

Seals 15,16 are set to seal a pumping or motoring chamber or space between the two elements of a pair of elements or disc-pair. Inlet means and outlet means are attached to the working chamber, pumping or motoring chamber or space as known from my parental U.S. patent application Ser. Nos. 224,769, now abandoned, and 282,990. The inlet means and outlet means are commonly inlet valves and outlet valves or closeable inlet and outlet ports.

According to my parental U.S. application Ser. No. 282,990, such disc pairs are working satisfactory in the subcritical range. The subcritical range is that range, where the strength of the disc exceeds the force which tends under pressure in the spring-chamber to depart the discs away from each other. For high pressure in the chamber it was required to clamp two discs together in order to prevent the departure of disc portions and seals from each other under the high pressure in the supercritical range, where the forces of pressure in the chamber between the discs would exceed the holding spring strength of the disc portions 1.

The invention now overcomes the requirement of clamping of disc pairs, which is expensive, by the extension of the critical pressure point between the subcritical range and the super critical range to a higher critical pressure point. Thereby the expensive clamping can be spared until the extended higher pressure point in the chamber is reached.

To obtain the extension of the pressure range between the subcritical and the supercritical ranges to a higher pressure, the discs are in accordance with this present invention provided with strengthening portions.

In FIG. 1 the strengthening portions are portions 3 and they extend radially outwardly from the tapered portions or spring-action portions 1. Additional strengtheners 4 are added in FIG. 1 to the strengthening portions 3. They are extending axially from the outer portions of strengthening portions 3.

Figure 2:
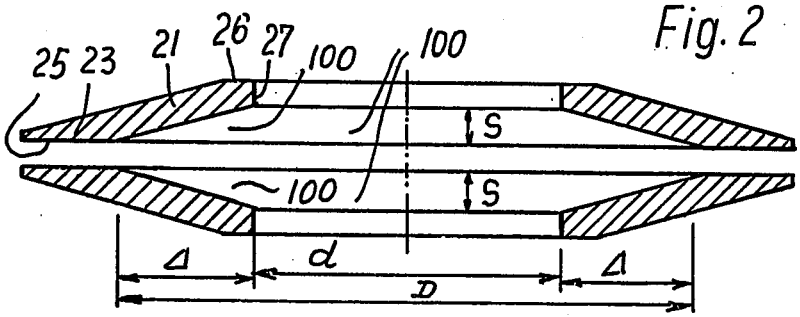
FIG. 2 is a longitudinal sectional view through elements of the invention.

In FIG. 2 the strengthening of the disc is obtained from a conventional disc spring by grinding or machining the outer axial end portion of to a radially plane face 25, which at the same time is one of the seat faces. FIG. 2 thereby provides a very simple and inexpensive disc for a higher critical pressure point. Because common disc springs which are inexpensively available on the market can be used. It should be noted however, that the available stroke of the disc spring will decrease.

Figure 3:
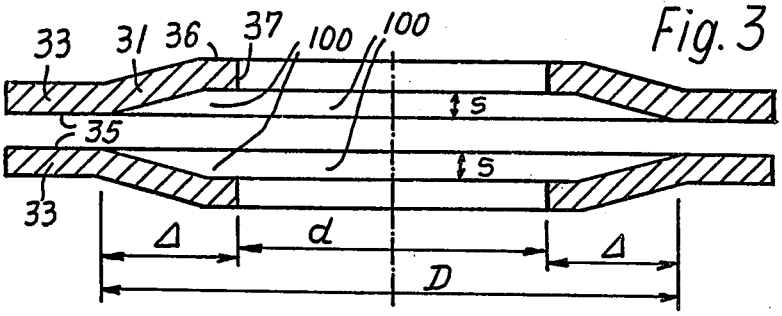
FIG. 3 is a longitudinal sectional view through elements of the invention.

In FIG. 3 another simple strengthened disc with spring action for the increase of the critical pressure point to a higher pressure is shown. Here the outer ends are formed as flat discs 33, which constitute the strengthening portions in this Figure. The radial inner portions are extending radially inwards from the tapered portion 31 and form there the one seat face 36, while the outer portions 33 form the other seat face 35.

The strokes of the flexible pumpable discs with inclined stroke portions 1,21,31 in FIGS. 1 to 3 are able to make a stroke "S" as shown in the figures. For a long lifetime of the discs of the invention the appearing strengths in the portions of the elements should be considered. Short strokes "S" will increase the lifetime, because the strengths in the materials will then vary between closer values than they would at longer strokes "S". Material and details of the forms have a great influence on the lifetime and on the permissible maximum of strokes in units of time.

When the elements of the invention of FIGS. 1 to 3 are used as pump(s), a top holding plate 10 and a bottom holding or support plate 10 are assembled. These top and bottom plates form end plates, when the axes of the elements are laid horizontally. The pump head of FIG. 9 may be assembled to one end of the pump element set and a stroke drive means may be set to the other end of the element pair. The parental applications show details of samples of pump heads and of drive means for driving the strokes "S" of the elements.

Figure 9:
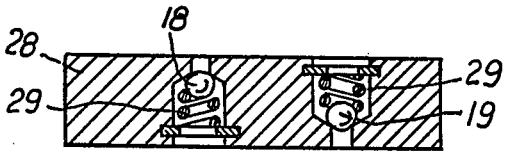
FIG. 9 is a longitudinal sectional view through a pump head of the invention.

In FIG. 9 a simple sample of a pump head is provided. It may be laid as pump head 28 onto one end face (seat face) 26 or 36 or 6 of the set of FIGS. 1, 2 or 3. Head plate 28 contains the inlet valve 18 and the outlet valve 19. The valves may be supported by springs 29. Instead of valves other inlet and outlet means may be provided, if so desired.

FIG. 1 also demonstrates, that it is desirable and of benefit to lay the ring plate 11 between to opposed elements in order to be able to obtain a seal seat for the plasticly deformable seal 15, which in this case is the medial seal or inner seal 15. The end plates 10 are commonly getting smaller inner diameters than the elements 1,21,31, in order to form a seal seat for the end seals 16. These end seals 16 are also of plasticly deformable material, for example, O-rings. The medial outer ring plate 11 must be of a relatively big outer diameter in order to maintain enough radial strength against radial deformation. Otherwise the ring plates 11 and 10 may be plates, which are simply grinded on surface grinders in order to have radially plane and parallel axial end faces.

For pumps it is important to prevent dead spaces or dead volumes inside of the pump means. Because a big volume in the pumping chamber 100 inside of the spring pair or inside of the pair of elements of the invention would fill the volume with fluid. Fluid is however compressible at least slightly and would compress considerably under the high pressure for which the pump of the invention is desired.

Therefore dead space fillers 13 are assembled inside of the pumping or working chamber 100. Because without them, the pump would have a reduced volumetric efficiency because of the compressibility of fluid. The dead space filler 13 reduces the amount of fluid in the pumping chamber and thereby the amount of compressibility in the chamber. Because the dead space filler 13 is made of uncompressible material, for example, of steel, iron, carbon fiber or the like. A passage 14 must be provided in order to permit the fluid in the bottom portion of the pump chamber to flow into the top portion of the pumping chamber and vice versa.

Filler 13 commonly gets a medial radial extension ring 12 which also acts as dead space filler. At same time it can be a seal holder to keep the medial seal 15 in its place.

End plates 10 and medial radial extension plate 12 are also serve as supports for the tapered spring action portions 1,21,31 of the elements of the invention. Because if there would not be axially strong supports, the tapered spring able portions 1,21,31 of the elements might axially bow or bend out or break under the very high inner pressure in the chamber between the portions 1,21,31. The pump of the invention is able to work with pressures of many hundred atmpspheres, for example, also with thousand atmospheres, if the assemblies of FIGS. 1 to 3 are used. At such high pressure even strong spring steel might bow or bend.

The calculation of the delivery of the pump per stroke "S" of an element of the invention is done, as follows:

An infinitesimally small radial portion of the tapered portion of the element may be: "dR", while the respective axial portion of the said portion of the element may be: "dY". This gives the tapered area: "dA".

Thereby FIG. 10 is obtained and it brings the development of the calculation of the pumping action as shown in FIG. 10.

The pumping delivery volume of the tapered portion 1 of an element of the invention then becomes:

$$V_T=(\pi/6)tgH[R^3-r_1^3] \quad (1).$$

The radial extension of the tapered portions 1,21,31 is shown in FIGS. 1 to 3 by the greek letter "delta" and is the half of the difference between the inner diameters "d" and the outer diameters "D" of the tapered portions 1,21,31 of the elements of the invention.

The delivery volume radially inside of the inner diameter "d" per a stroke "S" of the element is $$V_d = r_1^2 \pi S \quad (2)$$

wherefrom follows, that the sum of the delivery volume per partial stroke "f" of the stroke "S" is:

$$V_f = (\pi/6) tg H_f [R^3 - r_1^3] + r_1^2 \pi tg H_f (R_o - r_i) \quad (3)$$

and, wherefrom also follows, that the delivery volume of a pair of elements, as shown in FIGS. 1 to 3, is 2 times of the calculated volume "$V_f$" of equation (3). In the above equations the following measures, may by way of example, be used: V = volume in cubicmillimeter and radii R and r in mm. Pi is about 3.14 and kappa is the angle kappa of FIG. 10 to be used in degrees.

For more details of the technology of the elements of the invention, Rotary Engine Kenkyusho Report RER-8109 may be studied. It is available from Rotary Engine Kenkyusho, 2420 Isshiki, Hayama-machi, Kanagawa-Ken, Japan, against payment of the costs and against information for what the study of the report is desired.

Another consideration, which underlies my invention(s), is the following:

When fuel, for example petrol or gasoline, is injected into the hot air in the cylinder of an engine, the fuel is pressed under a medial pressure of a few hundred atmospheres through a nebulizing jet into the hot compressed air in the cylinder chamber. The fuel thereby forms into small droplets of a high velocity. The small droplets of the then almost vaporized or nebulized fuel are vaporizing to a gas the faster the injection velocity, the higher the heat, and the smaller the ball particels of the fuel are. The size(s) and injection velocities depend naturally on the form and size of the jet wherethrough they are injected, but also extremely on the pressure with which the fuel is injected. The injection speed is basically a function of the injection pressure by the basic equation:

$$W = \sqrt{2P/\rho} \quad (4)$$

with "W" = velocity; P = pressure and "rho" = density. If for example, water is injected, the injection velocity may reach roughly the sonic speed of water of roughly 1400 m/s at an injection pressure of tenthousand atmospheres, when losses in the jet and other losses are neglected.

Having now shown in my parental applications, that the elements of the invention can also be used as water pumps for very high pressures of many hundred or even a few thousand atmospheres, and, having shown in my co-pending Japanese patent application Ser. No. 56-181,584, that the dead space can be eliminated in cylinder-combustion engines, whereby the compression end pressure can be rised very high, I now conclude, that it should be possible to speed up the combustion of fuel in combustion engines and thereafter inject water under high pressure for the very fast transformation of water into steam. It should then be possible, to obtain a "FOSSIL FUEL COMBUSTION—STEAM ENGINE" which would for an impressive portion of the expansion work as a steam engine and thereby save fuel and reduce the fuel consumption of combustion engines to a fraction of the present fuel consumption per unit of given power.

FIG. 4 shows in a longitudinal sectional view through the basic concept of one of my fossil fuel combustion steam engines of the present invention.

Piston 41 is reciprocating in cylinder 40 with cylinder head 46. Demonstrated are the following positions or locations of the piston 41:

- dotted lines 50 show the outer position of the piston head;
- full lines 51 show the operation start position of the piston head; and,
- point-dotted lines 52 show the inner position of the piston head of piston 41.

These different positions or locations of the piston head of piston 41 are important for the understanding of the engine of the invention.

The first position 50 is the outer location, at which the piston is retracted into the outermost position, at which the cylinder 40 has its greatest volume.

When the piston 40 moves upwards in the cylinder towards its innermost location, commonly the piston compresses the intaken air. The inlet valve is then closed in the common four stroke engine.

In the engine of my invention, as illustrated in FIG. 4, however, the inlet valve 42 is kept open all the time when the piston 41 moves upwards from the first position to the second position 51. The second location 51 is the location, at which the inlet valve 42 closes the intake 43 and thereby the compression of the intaken air begins, when the piston 41 moves further upwards towards its third or innermost, the inner position or location 52. The important position 51 is therefore also called the starting position or the operation start position or location.

After the piston 41 has reached its third or innermost location, the air is compressed. I prefere to compress it to a very high pressure in a very small volume. For example, to a much higher pressure than in common four stroke gasoline engines.

At the third position 52 of the piston 41 I inject fossil fuel under very high pressure through injection device 47 to steam the fuel very fast in the hot air for a very fast combustion under high temperature and increase of pressure and temperature. It is important, to note, that, when the second location is in the middle between the 1st and 3rd locations 50 and 52, the air taken in is only the half of the maximum of the cylinder volume. Consequently only the half of fuel compared to the common engine is needed to burn in stoichiometric value 1 in the smaller amount of air, namely in the half amount of compressed air of the common four stroke gasoline engine. That shows, that my engine uses only a fraction of fossil fuel of the common four stroke gasoline engine. In the discussed sample, a half of it.

This would make the impression, that my engine would also give only the half of the power of the common four stroke engine of equal maximum of volume of the cylinder 40.

That however, I do not assume.

Because, according to my invention, the compression was very high, the temperature at location 52 of the piston after combustion or slightly down therefrom in the expansion stroke is very high and my fuel balls were gased fast due to the high pressure injection. Thereby the fuel combustion was very fast, hot and intensive. However, the high temperature could not heat the walls 40 of the cylinder much, because the combustion and heating up in my engine was so very fast, due to my high injection pressure.

Therefore, as soon as the combustion of the fuel is about completed, I inject water through the first water injection means 48 under again a very high pressure in order to obtain very small water droplets of high velocity at the water injection. These water droplets will transform or vaporize into steam again very fast. The faster, the better. And, the fastness of steaming is obtained by the very high pressure of my water injection. Because my invention(s) gave me the inexpensive high pressure water pump.

When water transforms into steam at atmospheric pressure, the steam will take a volume, which is roughly 1600 times the volume of the water which is steamed. And, for example at 100 atmospheres combustion pressure the steam will still take roughly eighty times of the volume of the water, which becomes injected.

Therefrom follows, that the amount of water, which is to be injected to fill the rest of the cylinder, which was not filled with air at the upwards stroke of the piston 41, is rather small. The injection of water under high pressure may either be done by a single water injection means 48 or by a plurality of water injection devices 48, 49 in succession.

The actual amount of water to be injected depends also thereon, at which pressure 6 in the pressure-volume diagram of FIG. 5 the gas-steam shall exhaust at the outer position 50 of the piston after the expansion stroke, when the outlet valve 44 opens.

FIG. 5 shows the volume-pressure diagram of the engine of FIG. 4. The first location 50 of piston 41 is below 6 at 1 in the V-P diagram of FIG. 5. At the piston stroke from the first location 50, (1 in FIG. 5) to the second piston position 51, the stroke 1–2 is done in the V-P diagram of FIG. 5. The inlet valve 42 is open and the pressure remains the atmospheric pressure 1.

At the second location 51 of the piston 41, which is position 2 in the V-P diagram of FIG. 5, the inlet valve 42 closes. At the further stroke of the piston 41 from its second location 51 to its third location 52, which is position 3 in the V-P diagram of FIG. 5, the compression of the intaken air occurs along the compression curve 2–3 in FIG. 5. Around point 3 in FIG. 5 the fuel injection begins and the fast vaporization of the fuel and the fast following and completing combustion leads to the increase of pressure and temperature along the line 3–4 in the V-P diagram of FIG. 5. That is the time, when the piston 41 is in its third position or location 52. A portion may depart from the line 3–4 to the line 3- before 4–7 in case of a diesel like combustion. At the combustion-time remainder or after completion of the combustion, the piston 41 starts to move downwards in the expansion stroke. For example, along curve 4–5 in the V-P diagram of FIG. 5. In the meanwhile somewhere between points 4,7 and 6 in the diagram of FIG. 5 the injection of water has taken place and the water was transformed into steam. Actually fuel-combustion and steaming may partially temporarly mix. The steaming of the water will take a portion of the heat out of the combusting or combusted fuel-air-mixture. And, finally, the gas will further expand and the steam will expand substantially along the lines 4–5–6 in the diagram of FIG. 5 until finally in the first position of piston 41 the gas and steam will leave the cylinder 40, because the outlet valve 44 opens in the near of position 6 in FIG. 5. Finally the rest of steam and gas will be blown out of the cylinder between 6 and 1 in the diagram of FIG. 5. This may be done in the exhaust stroke of piston 41, or in case of two stroke operation immediately about in the position 6-1 of piston 41.

Actually same time for the steaming of the injected water will be needed and the gas-combustion may not be fully completed as explained heretofore, wherefrom follows, that the expansion may not exactly follow the expansion curves of presently common gas upon or diesel engines. The actual curves 4–7–5–6 will however become known further development of my engine and they will depend on the relative amounts of water to be injected. The relative amount of water will be the amount relatively to the volume of the entire piston stroke. Of influence also will be the percentage of the second location 51 between the outer and inner or first and third locations of the piston 41 in its upwards stroke.

In my considerations my engine of FIG. 4 should have a number of features. For example, the amount of fuel per unit of power obtained will be less compared to the present engines. Further, the combustion pressure will take place at higher pressures and temperatures, whereby the thermical efficiency of the engine is generally increased. Further, the steam from the water will considerably cool down the medial temperature of the expansion stroke from 4 to 6 in FIG. 5. Thereform follows, that the amount of heat transfered to the wall of cylinder 40 will be considerably less, than in common engines. Consequently losses by heat transfer to the cylinder walls will be smaller in my engine than in common combustion engines. Thereby again the efficiency of my engine will become higher than that of presently common combustion engines. A rule of the thumb was, that $\frac{1}{3}$ of the engergy runs into the cylinder walls by heat transfer, $\frac{1}{3}$ of the energies runs into losses in the thermodynamic cycles and $\frac{1}{3}$ of the energies runs into the muffler or out of the engine in the exhaust. But with my engine, the losses of the $\frac{1}{3}$ to the cylinder walls should be reduced. And, my engine will use a smaller amount of gasoline, than which is required at present in common engines of a given volume of a cylinder 40.

It is true, that my engine also has problems. For example, my engine must drive my water injection device(s) which is to be taken away from the power produced in the engine by the injected fuel. The amount of energy to drive the injection devices, however is small compared to the efficiency benefits obtained. Also true is, that the vehicle which uses my engine will have to carry a tank with water in it, which is uncomfortable compared to the presently common vehicles. However the benefit by saving fuel and by saving money at the gasoline stations when the fuel is bought, is so considerable, that the overall benefit if the engine appears.

Naturally, the thermodynamic details must be obeyed in the use of the engine. The amount of air intake must be in balance with the amount of fuel injected. The amount of water injected must be suitable to take the heat from the combusted gas. It must be in balance with the expanded burned fuel-air mixture. These details will be worked out more in detail in the coming development of my engine. If my time will permit it, the thermodynamic and mathematical relationships will be established at said development of my engine and at a later time probably become published.

FIG. 8 demonstrates, that care has already been taken to make very hot temperatures possible in the engine of FIGS. 4 or 6. When such temperatures become very high, for example around 3000 to 4000 centigrade, the common cast iron or aluminium cylinder wall may not be useable any more. Materials for higher pressure and temperatures may be used for the walls of cylinders 40,60,71 in FIGS. 4 or 6. Such high-pressure-high temperature material might then be brittle. It may require a outer strengthening means, or holding means.

Consequently, FIG. 8 demonstrates, that an outer holding or support frame may be set around the respective cylinder 76. Such outer housing 800 may form outer chamber 78 or 79 or more outer chambers around the cylinder 76. Through entrance(s) 80, 81 fluid under pressure may then be led for example from a fluid tank 801 by supply sources, for example pumps 802, 803 of different pressure 806, 807, over individual passages 804, 805 into the outer chamber(s) 78,79. That may be done temporarily and parallel to the pressure which appears at the respective time inside of the cylinder 76. Because I have the pumping devices to supply such pressure disclosed in my invention(s).

The consequence of the arrangement of FIG. 8 therefore is, that even a brittle material of cylinder wall 76 may not break, because the pressure from the inside and that from the outside may be at all times equal or considerably nearly equal or at least partially equal, so that one sided break-bending forces are avoided or reduced.

One possibility also is, to lead water into the outer chamber(s) 78,79 to warm it by the heat from the cylinder wall(s). The benefit therefrom would be, that the injected water would already be hot and would take less heat energy away from the combusted air-fuel mixture in the cylinder.

A side benefit might become, that the water in the outer chamber(s) 78,79 may already steam near the outer face of the wall of the inner cylinder 76. Such steam might be separately taken off from chamber 78 or 79 and be used to be jetted against the water injection stream in order to vaporize the injected water to still smaller balls.

The speed of the transforming of the water balls into steam, the sizes of the water balls in dependance of the injection pressure and so on, could be calculated by my mathematical works of 1945–1946 "Verdampfung von Fluessigkeitstroepfechen in heisser Luft". Regrettably however, the extensive mathematical works have become lost over the time and can not be found immediately now. They may be contained in some of my "last wills" which have been deposited at courts at places where I lived at the respective times.

Since I have disclosed in at least one of my mentioned co-pending patent applications, that high pressures can also be obtained by external combustion engines with small or no dead space in the compressor(s), it is also possible to run my fossil fuel combustion steam engine as an outer or external combustion engine with a separated or external combustion chamber.

FIG. 6 demonstrates a schematic longitudinal sectional view through an external combustion fossile fuel steam engine of my invention(s) with the thereto belonging volume-pressure=V-P diagram of FIG. 7.

At least one compressor 60,61 (with for example cylinder 60 and reciprocating piston 61 therein) delivers the compressed air through the outlet valve 63 over passage 64 into the external combustion chamber 70. Fossil fuel, like oil, gasoline, petroleum, diesel fuel, coal, coal powder, coal blocks of my mentioned Japanese patent application or the like is injected through injection means 65 for an immediate combustion in the external combustion chamber 70 in the air which was delivered through passage 64. When there are more than one compressor, there may also be multiples of passages 64, as the Figure shows.

After the combustion of the fuel or close to the end of the combustion of the fossil fuel, water is injected into the hot gases. In this case of FIG. 6, however, not into the cylinder, but into the external combustion chamber 70. The injection of the water may be done by a single injection means 65 or by plural injection devices 65,66. The injected small ball water streams are shown by references 68 and/or 69. This water steams and expands similar to FIG. 4, however, within the external combustion chamber 70 or at least partially therein. Thereafter the still pressurized gas-steam mixture leaves the external combustion chamber 70 to flow through passage 722 into the larger expansion cylinder 71, to expand therein under driving of piston 72. Piston rings 73 may be applied for sealing, as common. The sizes and strokes of the compressor(s) and of the expansion cylinder 71 with piston 72 must be in the proper relationship and so must be the amount of injected fuel and of injected water. Cylinder head with valves may be set onto cylinder 71 as shown by 46. The valves are preferred to be those of FIG. 6, namely inlet valve 62 located inside of outlet valve 63 with flat front faces to obtain the deadspaceless cylinder(s) 60 and/or 70. More details of said valves are in my mentioned co-pending applications.

FIG. 7 shows and demonstrates the compression stroke along line or curve 1–2 and thereby the compression of the intaken air. Line 2–3 shows the constant pressure combustion of the fossil fuel in the compressed air which takes place after the fuel injection into the external combustion chamber 70. Line 3–4 shows the steaming of water and the expansion of the water-steam still at constant pressure in the external combustion chamber 70 after the water-injection. And line 4–5 shows the expansion at reducing pressure of the gas-steam mixture in the expansion or working stroke of piston 72 in the expansion stroke or working stroke of the piston 72. At 5 in FIG. 7 the gas-steam mixture leaves the cylinder 71 after the opening of its outlet valve.

FIG. 11 demonstrates a general improvement of the output power of crankshaft operated combustion engines. These engines work very effectively in motor bikes, cars and the like. However, they are still too heavy for use in vertical take off aircraft. I therefore desire to obtain a bigger output of power from such engines at a given weight. This is obtained partially by the application of my rotary valves with big inlet and outlet cross-sectional areas, for examples of my German patent application publication Ser. No. 31 35 675. The double turbocharger arrangement of my U.S. patent application Ser. No. 348,633 also adds to the increase of output power per a given weight of the engine.

However, one limitation for the output power of engines is given by the centrifugal forces of the connecting rods which surround the eccentric portions of the crank shafts. The centrifugal forces created by the con-rods are becoming so high at high rpm. that the hydrodynamic fluid films in the crankshaft bearings can not bear the centrifugal forces any more. The bearings would tend to weld, if the rpm would become further increased.

FIG. 11 overcomes these limitations of the rotary revolutions of such engines and makes higher rpm and thereby higher power possible. I obtain the higher rpm and power per engine by applying hydrostatic pressure pockets in the crankshaft bearings at the specific places, where the high centrifugal forces act. The pressure in the pockets is obtained from a pressure supply source and the cross-sectional area of the pockets and of the sorrounding sealing lands is properly dimensioned to permit them to bear the appearing centrifugal forces accurately. The counter weights on crankshaft portions can thereby partially or entirely be spared and the weight of the engines can become reduced while the output power becomes increased.

Thus, according to FIG. 11 I drive an oil pump by the crankshaft. I prefer to use a variable pump of one of my patents mentioned in the Japanese patent application Ser. No. 54-164,869. Preferred is such a pump, which is variable in delivery quantity of fluid per revolution. The oil pump or its delivery flow may additionally be adapted to a control of the height of the pressure in the fluid which is delivered. The quantity delivery control and the pressure hight delivery control may be adapted to a control in dependence of the rpm of the crankshaft of the engine to supply the correct amount of oil quantity and of pressure therein into the fluid pressure pockets 86,87 of the crankshaft bearing(s) of my engine of FIG. 11.

The oil or fluid is delivered from the said pump into passage(s) 85 in crankshaft 83 of the engine. Crankshaft 83 revolves with concentric bearings in housing or crank-casing 82. The crankshaft 83 has the eccentric bearing portions 883 which carry and bear the connecting rod(s) 84.

According to the invention, the hydrostatic pressure pockets 86 with surrounding sealing lands are provided in the concentric crankshaft bearings at those places of the crankshaft, where the centrifigal forces of the eccentric portions 883 of the crankshaft are causing a load. A branch passage 85 delivers the pressure fluid from the main passage 85 into the respective pocket 86. As seen in the Figure, the branch passages 85 can be very easily drilled into the crankshaft, because they are just radially directed and open radially outwards, where they port into the respective pressure pockets 86. Other branch passages 85 branch also radially directed off from the main passage 85 and they meet the inclined passages 88, which port into the pocket(2) 87 in the eccentric portion(s) of the crankshaft. The now mentioned branch passages 85 are radially outwardly closed by closers 89. The eccentric fluid pressure pocket(s) 87 are set into the crankshaft at that place(s), where the centrifugal force of the connecting rod(s) 84 applies (apply) a load. As seen in the Figure, the pockets 86 and 87 are diametrically opposed in the respective crankshaft portions. The cross-sectional area of the pressure pocket(s) 87 and the surrounding sealing land(s) are properly dimensioned to carry at the respective rpm of the crankshaft the load of the centrifugal force created by the conrod(s) 84 in combination with the pressure in the fluid at the respective time.

The proper arrangement of the location and sizes of passages, pockets and sealing lands in combination with the quantity and pressure of the sealing fluid supplied into the passages and into the pockets 85,87,86,88 makes it also possible to take off entirely or partially the counter weights 90 of the presently common crankshafts of engines. Thereby the weights of the engines can be reduced, while at the same time the rpm and thereby the output power of the engine(s) can be considerably increased.

Referring again to the fuel combustion steam engines of FIGS. 4 to 7, it should also be considered, that the pressure in the combustion stage could be raised above the pressure of the critical point of steam and water. This critical point commonly is around 225 atmospheres. The steam than takes a volume equal to the volume of water of equal quantity. The steaming heat to steam water into steam is then zero. Further it should be obeyed, that the polytropic exponent of steam and of overheated steam is not equal to the compression exponent of air.

These are matters of further investigation. Not all details of behaviour of the engine of FIGS. 4 to 7 are fully known presently. It may therefore be desired to run the expansion partially with overheated steam. It might also be desirable not to take all the heat out of the combusted fuel-air mixture and run in the expansion a combination of burned fuel air-gas and steam or overheated steam expansion. The relation of the location of the second location 51 of the piston 41 at the compression stroke may have a big influence as well as the amount of water injected. Further it may become of great influence at which location the injection devices 48,49 etc. are placed relative to the third and first locations of the respective piston, for example, 41.

To details of design belongs also, what is desired in the specific design of the engine. Either higher efficiency and saving of fuel or better cooling of the parts of the engine. An other consideration in design might be, whether the specific engine will be desired for greater power output or for greater economy. It is therefore not excluded in specific design cases to maintain the major portion of expansion with fuel-air burned mixture, but with limited water injection if so desired.

Having heretofore described the embodiments of the invention in terms of commonly understood terminology, the aims, objects and embodiments of the invention might partially also in different terms of technology be described for more clearer definition of the invention as follows:

What is claimed, is:

1. A cylinder in a fluid handling device with temporary high pressures and temperatures in said cylinder which vary in continuing cycles periodically, wherein at least two outer chambers are mounted sealed from each other around an upper portion and a lower portion of said cylinder while said outer chambers are formed in an outer housing which surrounds that outer chambers around said cylinder;

wherein individual ports are provided through said outer housing to said outer chambers individually;

wherein said outer chamber around said upper portion of said cylinder is a first outer chamber and said outer chamber around the lower portion of said cylinder is a second outer chamber with a first port of said ports on said first outer chamber and a second port of said ports on said second chamber;

wherein said first port is communicated to a supply source of a first pressure and said second port is communicated to a supply source for a second pressure to fill said first outer chamber with said first pressure and to fill said second outer chamber with said second pressure; and;

wherein said cylinder temporary obtains said first pressure substantially as a first medial pressure radially inwards of said first outer chamber, while said cylinder temporary obtains said second pressure substantially as a second medial pressure radially inwards of said second outer chamber;

whereby the wall of said cylinder is at least temporary subjected to substantially equal pressures in the respective areas of said wall radially inwards of said first and second outer chambers in order to prevent excessive radial deformation of said wall under different pressures outwards and inwards of said wall of said cylinder.

* * * * *